US007874452B2

(12) United States Patent
Karr

(10) Patent No.: US 7,874,452 B2
(45) Date of Patent: Jan. 25, 2011

(54) CUP COVER

(75) Inventor: Stephanie Karr, 15030 SW. 139th Ave., Tigard, OR (US) 97224

(73) Assignees: Berkeley Law & Technology Group, LLP, Beaverton, OR (US); Stephanie Karr, Sherwood, OR (US)

( * ) Notice: Subject to any disclaimer, the term of this patent is extended or adjusted under 35 U.S.C. 154(b) by 768 days.

(21) Appl. No.: 11/187,792

(22) Filed: Jul. 22, 2005

(65) Prior Publication Data

US 2007/0017925 A1 Jan. 25, 2007

(51) Int. Cl.
*B65D 25/00* (2006.01)
*A63H 3/00* (2006.01)

(52) U.S. Cl. ..... 220/737; 446/74

(58) Field of Classification Search ..... 220/703, 220/737, 739; 446/72–74
See application file for complete search history.

(56) References Cited

U.S. PATENT DOCUMENTS

| | | | | |
|---|---|---|---|---|
| 5,326,300 | A * | 7/1994 | Sonders | 446/74 |
| 5,624,090 | A | 4/1997 | Gammelgaard | |
| 5,871,184 | A * | 2/1999 | Kaopio | 248/102 |
| 6,003,821 | A | 12/1999 | Fabian et al. | |
| 6,082,681 | A | 7/2000 | Rand | |
| 6,321,931 | B1 | 11/2001 | Hakim et al. | |
| 6,641,094 | B2 * | 11/2003 | Fishler | 248/102 |
| 6,707,777 | B1 * | 3/2004 | Cherry | 369/63 |
| 6,719,138 | B2 | 4/2004 | Austin et al. | |
| 6,739,933 | B2 * | 5/2004 | Taylor | 446/28 |
| 6,827,317 | B1 | 12/2004 | Risaliti | |
| 2002/0108960 | A1 * | 8/2002 | Watson | 220/739 |

* cited by examiner

*Primary Examiner*—Harry A. Grosso

(57) ABSTRACT

Embodiments of methods, and/or articles for covering a child spill proof cup are disclosed.

14 Claims, 6 Drawing Sheets

CUP COVER

BACKGROUND

Children of particular age groups may utilize cups of varying types and categories. Typically, children, such as toddlers, for example, may utilize child spill proof cups, which may additionally be referred to as anti-spill cups, "sippy cups" or no-spill cups, for example. Children that utilize these types of cups may carry a cup with them for long portions of the day and/or night, so as to have access to fluids at many hours of the day and/or night. For a variety of reasons, it may be desirable to provide covering and/or personalization of the cup, so as to provide protective functions and/or to encourage a child to carry the cup with them so that they may have access to fluids when they desire, and/or to add comfort to the feel of the cup, and/or to identify the cup as belonging to a particular child in situations where more than one child is present with a cup. Additionally, many children that carry and/or hold a cup during the day or night also may carry and/or hold a favorite toy or stuffed animal at the same time which may require both hands to be full. By combining the cup and the stuffed animal, or comfort toy, the child can more easily attend to both. Therefore, a need may exist for a device that addresses one or more of these concerns.

BRIEF DESCRIPTION OF THE DRAWING FIGURES

Subject matter is particularly pointed out and distinctly claimed in the concluding portion of the specification. Claimed subject matter, however, both as to organization and method of operation, together with objects, features, and advantages thereof, may best be understood by reference of the following detailed description when read with the accompanying drawings in which:

DETAILED DESCRIPTION

In the following detailed description, numerous specific details are set forth to provide a thorough understanding of claimed subject matter. However, it will be understood by those skilled in the art that claimed subject matter may be practiced without these specific details. In other instances, well-known methods, procedures and/or components have not been described in detail so as not to obscure claimed subject matter.

Children, such as toddler-age children may favor particular types of drinking conveyances. In one embodiment, a favored drinking conveyance of a child may be a particular type of cup, including a child spill proof cup. Child spill proof cups may additionally be referred to as "sippy cups", anti-spill cups or no-spill cups, for example. Child spill proof cups in accordance with the claimed subject matter may include a spill proof feature, such as a nozzle, straw or other feature that may reduce and/or eliminate spills, for example. Devices such as these may be referred to throughout the specification as cups, regardless of whether the devices are used primarily as drinking conveyances. Additionally, although referred to herein as child spill proof cups, embodiments of the claimed subject matter are not so limited. For example, at least one embodiment may comprise a cup cover suitable for use in conjunction with a cup other than a child spill proof cup.

Children that utilize a cup such as a spill proof cup may carry the cup with them for long portions of the day and/or night. Additionally, a parent or guardian of the child may encourage the child to carry the cup so as to provide access to fluids during the day. Children may occasionally misplace, drop or otherwise lose interest in a cup. If a cup is dropped or misplaced, the cup may become contaminated or less sanitary as a result, for example. Additionally, it may be desirable to personalize and/or increase the visual interest of a cup so that a child may be encouraged to retain the cup and/or carry the cup for longer portions of time. For a variety of reasons, including the reasons set forth above, it may be desirable to provide personalization and/or covering of a cup. A cup cover may provide particular functionality, such as the aforementioned personalization, and may additionally provide functionality including protection of a cup such as to minimize the possibility of contamination. Additionally, a cup cover in accordance with one or more embodiments may provide insulation of the cup to modulate the temperature of a fluid in the cup, and may provide enjoyment for a child by embodying the cover in the form of a caricature of an animal or other creature, which may include a stuffed animal or other creature, or other form such as the appearance of a toy that may be pleasing and/or comforting to the child.

Figure 1:
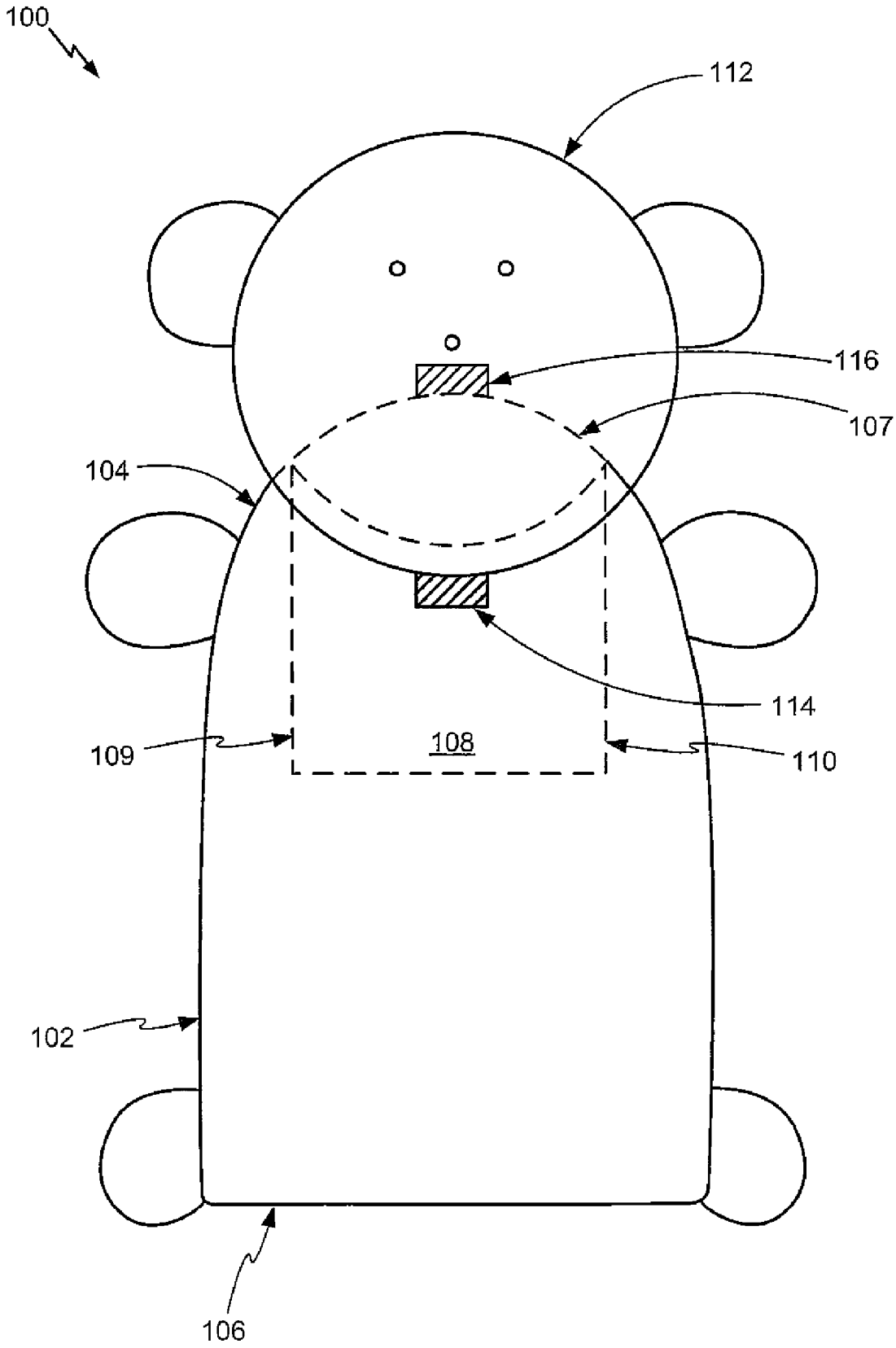
FIG. 1 is a front elevational view of a cup cover in accordance with one or more embodiments.

Referring now to FIG. 1, there is illustrated a front elevational view of a cup cover 100, in accordance with one embodiment. Although illustrated as a caricature of a bear, it is worthwhile to note that the claimed subject matter is not limited in this respect. The general appearance of the cover 100 may comprise any configuration that may be appealing to a child, such as a stuffed animal, for example. In this embodiment, cup cover 100 comprises a body 102. Body 102 may be formed from one or more materials, such as plush materials, terrycloth, velour, cotton or polyester, and may be stuffed in at least one embodiment. However, portions of embodiments of a cup cover described herein are not limited to any particular material or combination of materials, but may be formed from any material(s) suitable for use as a portion of a cup cover, for example. Body 102 includes an upper portion 104 and a lower portion 106. Upper portion 104 and/or lower portion 106 may include an opening, for example. In this embodiment, upper portion 104 includes an opening 107, and opening 107 defines a cavity 108. Cavity 108 may be at least partially populated by pocket 110, although in alternative embodiments there may not be a pocket disposed in cavity 108. Cavity 108 may be formed in body 102, and may have cavity walls 109. Pocket 110 may be at least partially disposed in and/or coupled to body 102, for example. Pocket 110 may be adapted to receive portions of a cup (not shown in FIG. 1), such as at least a portion of the body of one or more of the types of cups mentioned previously.

Pocket 110 may be formed from material that may exhibit elastic and/or compliant properties, such that when a cup is inserted in at least a portion of pocket 110 the material(s) may provide securing functions by applying pressure to the cup, for example. However, in other embodiments, pocket 110 may comprise one or more materials that may exhibit one or more properties, including non-elastic properties; absorbent properties; high friction or "grip" properties such as may be found in rubberized material; waterproof properties; or combinations thereof, for example. Pocket 110 may comprise one or more layers of material, and the layers of material may provide differing functions, for example. Additionally, cavity 108 may be adapted to receive one or more portions of a cup, such as a spill proof cup. Cavity walls 109 may additionally be formed from material that may exhibit elastic and/or compliant properties, such that when a cup is inserted in at least a portion of cavity 108 the material of cavity walls 109 may provide securing functions by applying pressure to the cup, for example. Cavity walls 109 may additionally one or more materials that may exhibit one or more properties, including non-elastic properties, absorbent properties, high friction or "grip" properties such as may be found in rubberized material, and/or materials exhibiting waterproof properties, or combinations thereof, for example.

Continuing with this embodiment, lower portion 106 may be closed or may include an opening, such as to allow access to cavity 108 and/or pocket 110, for example. This concept may be better explained with reference to FIG. 4, later. Cup cover 100 may include a top 112. Top 112 may comprise a portion of the overall animal or creature caricature, such as the head, in at least one embodiment. Top 112 may be configurable, and may be configurable to enable repositioning of the top relative to the body. For example, positioning of the top 112 relative to the body 102 may include covering of at least a portion of pocket 110, and/or portions of a cup when the cup is inserted at least partially in pocket 110, and/or not covering portions of the pocket and/or cup, for example. Covering the pocket and/or cup may provide protective functions such as by protecting portions of a cup that may come into contact with a child, for example. Top 112 may be coupled to the body 102, such as by being attached to the body 102 at one or more locations 116 of the periphery of the top 112. In at least one embodiment, the top 112 may be sewn at one or more locations 116 to the body 102, such as to allow the top 112 to be configured to be repositioned by being tilted with respect to the body 102, for example. The top 112 may be configured by tilting, and tilting may be performed in any number of directions, such as toward the front, rear and/or sides of the body 102, and the claimed subject matter is not limited in this respect. Top 112 may include attachment portions 114. Attachment portions 114 may comprise one or more attachment devices, which may be complimentary, for example, such as pieces of Velcro®, a loop and hook, a snap, or a button and button hole, as just a few examples. Attachment portions 114 may enable repositioning of the top 112 relative to body 102, such as by being tilted with respect to body 102, for example. Attachment portions 114 may allow top 112 to be configured in an upright position and/or a tilted position with respect to body 102, for example, by enabling repositioning in the manner described previously. This may provide selective access to pocket 110 and a cup (not shown) that may be at least partially inserted in cavity 108 and/or pocket 110, for example. However, as will be explained in more detail later, the claimed subject matter is not limited in this respect.

Figure 2:
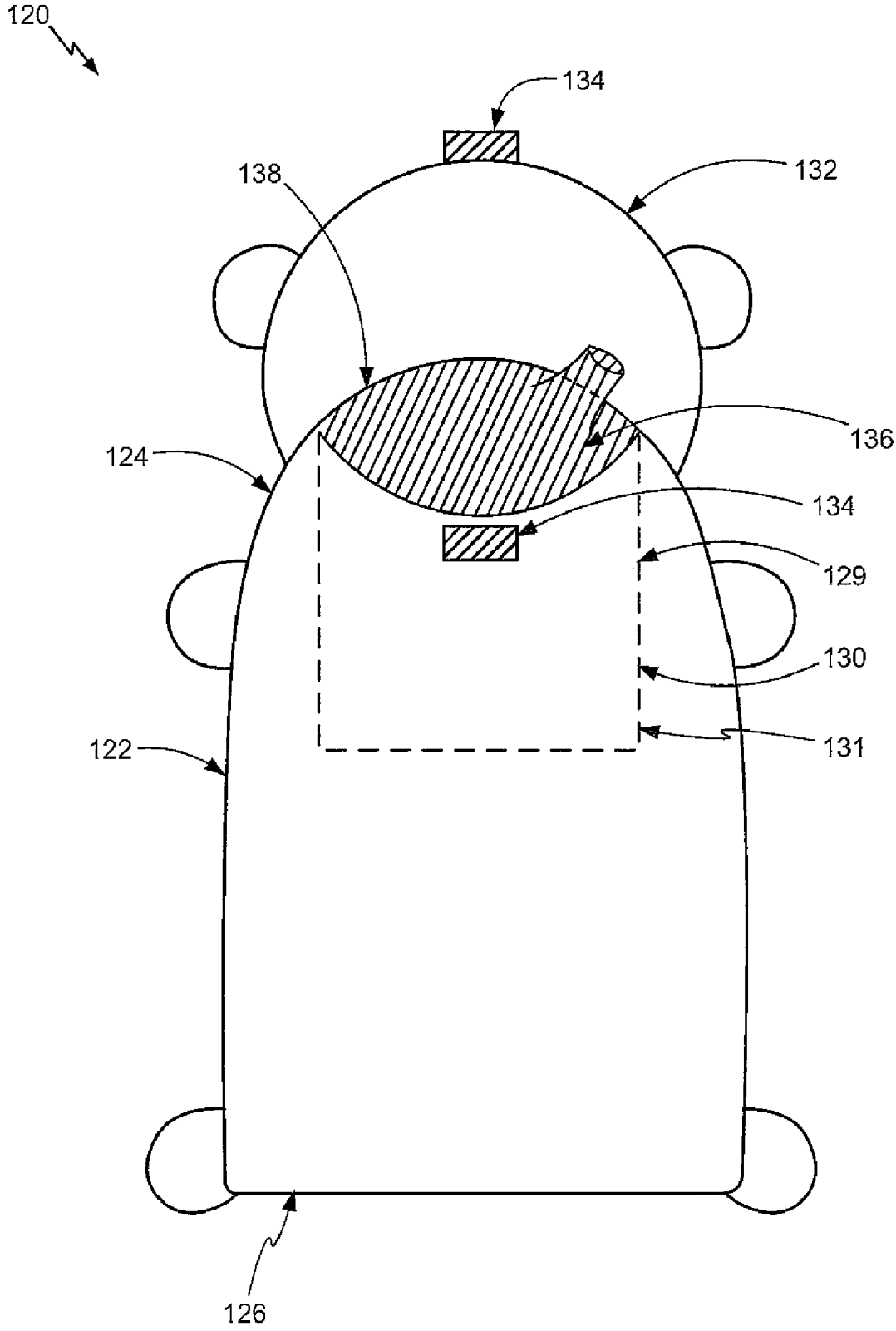
FIG. 2 is a rear elevational view of a cup cover in accordance with one or more embodiments.

Referring now to FIG. 2, there is illustrated a rear elevational view of a cup cover and a cup, in accordance with one embodiment. As mentioned with respect to FIG. 1, the general appearance of a cup cover may comprise a configuration that may be appealing to a child, and is not limited to that illustrated in FIG. 2, for example. In this embodiment, cup cover 120 comprises a body 122. Body 122 may be formed from one or more materials that may exhibit one or more properties, such as one or more of the materials as described previously, and may be stuffed in at least one embodiment. Body 122 includes an upper portion 124 and a lower portion 126. Upper portion 124 and/or lower portion 126 may include an opening, for example. In this embodiment, upper portion 124 includes an opening 128, and opening 128 defines a cavity 129. Cavity 129 may be formed from cavity walls 131. Cavity 129 may be at least partially populated by pocket 130, in one embodiment. Opening 128 provides access to cavity 129 and/or pocket 130. Pocket 130 may be at least partially disposed in and/or coupled to body 122, for example. Cavity 129 and/or pocket 130 may be adapted to receive a portion of a cup 136. Cup 136 may comprise one or more of the cups mentioned previously. Cavity walls 131 and/or pocket 130 may be formed from one or more materials that may exhibit one or more properties, such as elastic and/or compliant properties, such as one or more materials described previously, for example. Cavity walls 131 and/or pocket 130 may comprise one or more layers of material, and the layers of material may provide differing functions, for example.

Cup cover 120 may include a top 132. Top 132 may comprise a portion of the overall animal or creature caricature, such as the head, in at least one embodiment. Top 132 may be configurable, such as to enable repositioning of the top relative to the body, which may provide covering for a portion of pocket 130, and/or portions of cup 136 when the cup is inserted at least partially in pocket 130, for example. This may provide protective functions such as by protecting portions of cup 136 that may come into contact with a child, for example. Top 132 may be attached at one or more locations 138, such as a portion of the periphery of the upper portion 124, to allow the top 132 to be configured in one or more directions with respect to the body, but remain coupled to the body, for example. Top 132 may include attachment portions 134. Attachment portions 134 may comprise one or more attachment devices, which may be complimentary, such as explained previously. Attachment portions 134 may enable repositioning for top 132, and may allow top 132 to be repositioned such as by being tilted, for example. Attachment portions 134 may enable repositioning, such that top 132 may be configured in an upright position and/or a tilted position with respect to body 122. This may provide selective access to pocket 130 and cup 136, for example. However, as will be explained in more detail later, the claimed subject matter is not limited in this respect.

Figure 3:
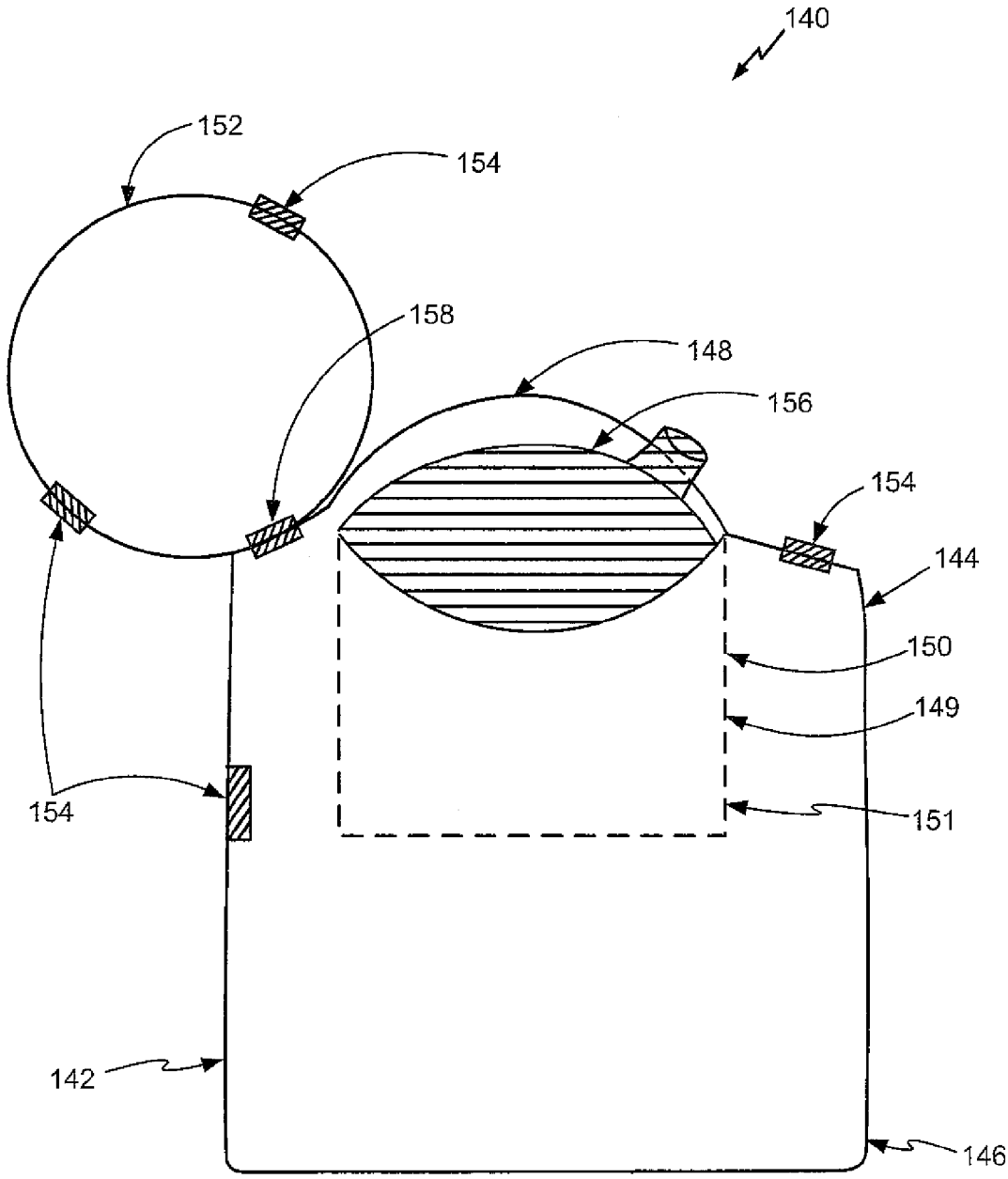
FIG. 3 is a side elevational view of a cup cover in accordance with one or more embodiments.

Referring now to FIG. 3, there is illustrated a side elevational view of a system 140, comprising a cup cover and a cup, in accordance with one embodiment. As mentioned with respect to FIG. 1, the general appearance of the system 140 may comprise a configuration that may be appealing to a child, and is not limited to that illustrated in FIG. 3, for example. In this embodiment, system 140 comprises a cup cover having a body 142, an upper portion 144 and a lower portion 146. Body 142 may be formed from one or more materials, as explained previously. Upper portion 144 and/or lower portion 146 may include an opening that may define a cavity 149, for example. In this embodiment, upper portion 144 includes an opening 148, and opening 148 may define a cavity 149. A pocket 150 may be disposed in cavity 149, for example. Cavity 149 may additionally include cavity walls 151. Pocket 150 may be at least partially disposed in and/or coupled to body 142, for example. Pocket 150 and/or a portion of the cavity 149, such as cavity walls 151 may be adapted to receive a portion of a cup 156. Cup 156 may comprise one or more of the cups mentioned previously. Pocket 150 and/or cavity walls 151 may be formed from one or more materials stated previously.

Cup cover 140 may include a top 152. Top may be configurable, and may be attached at one or more locations 158 to body 142. Top 152 may be attached to allow top 152 to be configured at different orientations with respect to body 142, for example. Top 152 may comprise a portion of the overall animal or creature caricature, in at least one embodiment. Top 152 may be configurable to provide covering functions for a portion of pocket 150, and/or portions of cup 156 when the cup is inserted at least partially in cavity 149 and/or pocket 150, for example. Top 152 may include attachment portions 154. Attachment portions 154 may comprise one or more attachment devices, as explained previously. Attachment portions 154 may enable repositioning of the top 152, such that top 152 may be configured in an upright position and/or a tilted position with respect to body 142, for example. This may provide selective access to pocket 150 and cup 156, for example, and/or may provide the capability of retaining the overall appearance of cover 142 as a caricature of an animal or other creature, for example. However, as will be explained in more detail later, the claimed subject matter is not limited in this respect.

Figure 4:
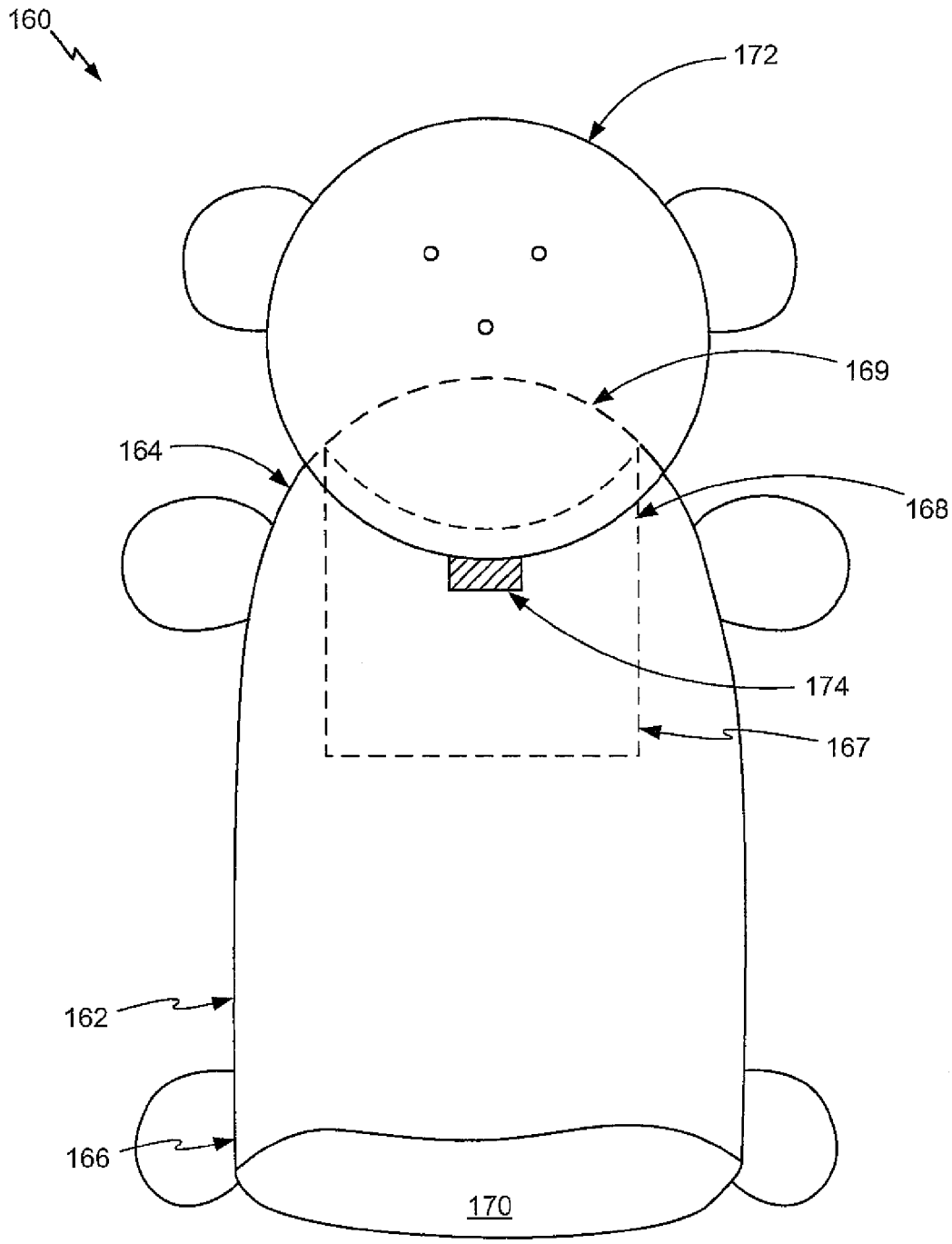
FIG. 4 is a front elevational view of a cup cover in accordance with one or more embodiments.

Referring now to FIG. 4, there is illustrated a front elevational view of a cup cover 160, in accordance with one embodiment. In this embodiment, cup cover 160 comprises a body 162, having an upper portion 164 and a lower portion 166. Body 162 may be formed from one or more materials, as stated previously. Upper portion 164 may include an opening 169 that provides access to cavity walls 167 and/or pocket 168. Cavity walls 167 and/or pocket 168 may be at least partially disposed in and/or coupled to body 162, for example. Cavity walls 167 and/or pocket 168 may be adapted to receive portions of a cup (not shown in FIG. 4), such as the body of one or more of the types of cups mentioned previously. Cavity walls 167 and/or pocket 168 may be formed from one or more materials, as described previously. Cup cover 160 may include a top 172. Top 172, which may be a configurable top, may be attached to the body 162 at one or more locations, such as described previously, and may comprise a portion of the overall animal or creature caricature, in at least one embodiment. Top 152 may be configurable to provide covering functions for a portion of cavity walls 167 and/or pocket 168, and/or portions of a cup when the cup is inserted at least partially in cavity walls 167 and/or pocket 168, for example. Top 172 may include attachment portions 174. Attachment portions 174 may comprise one or more attachment devices, such as one or more attachment devices stated previously. Bottom portion 166 may include an opening 170, which may provide access to cavity walls 167 and/or pocket 168 and/or a cup that may be inserted in cavity walls 167 and/or pocket 168, for example. Bottom portion 166 may comprise a draped portion of the body, which may drape over the cavity wall area and/or pocket area and/or a cup that may be inserted in the cavity walls 167 and/or pocket 168, for example. This draped portion may be movable by a child, such as to allow a child to reach into body 162 and grasp portions of a cup, cavity walls 167 and/or pocket 168, for example.

Figure 5:
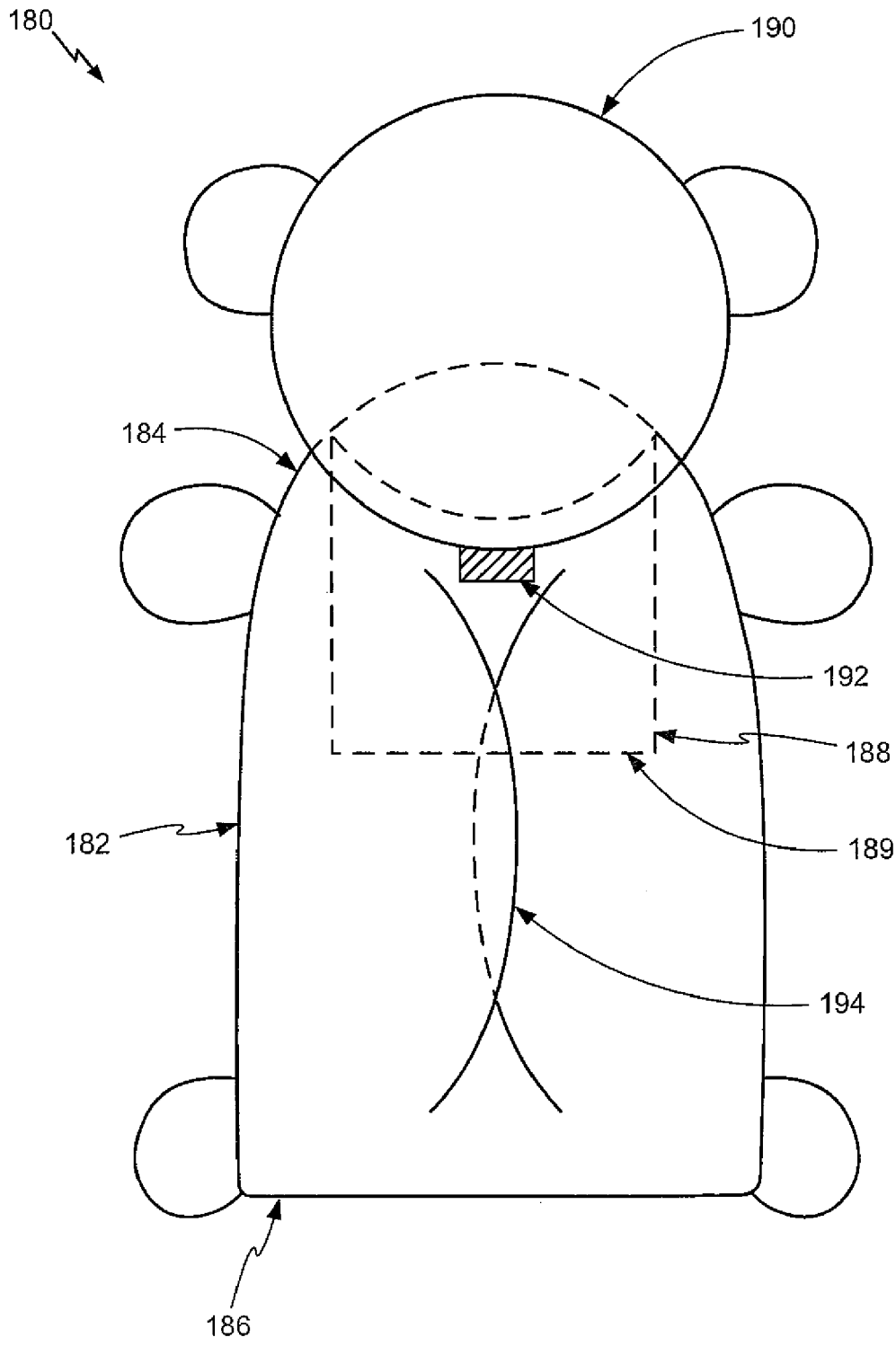
FIG. 5 is a rear elevational view of a cup cover in accordance with one or more embodiments.

Referring now to FIG. 5, there is illustrated a rear elevational view of a cup cover 180, in accordance with one embodiment. As mentioned with respect to FIG. 1, the general appearance of the cover may comprise a configuration that may be appealing to a child, and is not limited to that illustrated in FIG. 5, for example. In this embodiment, cup cover 180 comprises a body 182, an upper portion 184, and a lower portion 186, which may have similar characteristics as those of previously presented embodiments, for example. A cavity 187 may be formed in body 182. Cavity 187 may be formed from cavity walls 189. Cup cover 180 may include a pocket 188 disposed in cavity 187. Cavity walls 189 and/or pocket 188 may be adapted to receive a portion of a cup (not shown in FIG. 5). Cup cover 180 may include a top 190, and attachment portions 192. Top 190 and attachment portions 192 may provide functionality as described with reference to previously presented embodiments, for example. Body 182 may include aperture portion 194. Aperture portion 194 may comprise a hole, gap or slit, for example, that may provide access to pocket 192 and/or a cup that may be inserted in cavity 187 and/or pocket 192, for example. Aperture portion 194 may be at least partially obstructed by one or more materials such that the aperture portion 194 is not readily visible, for example. Aperture portion 194 may be movable by a child, such as to allow a child to reach into body 182 and grasp portions of a cup, cavity walls 189 and/or pocket 188, for example.

Figure 6:
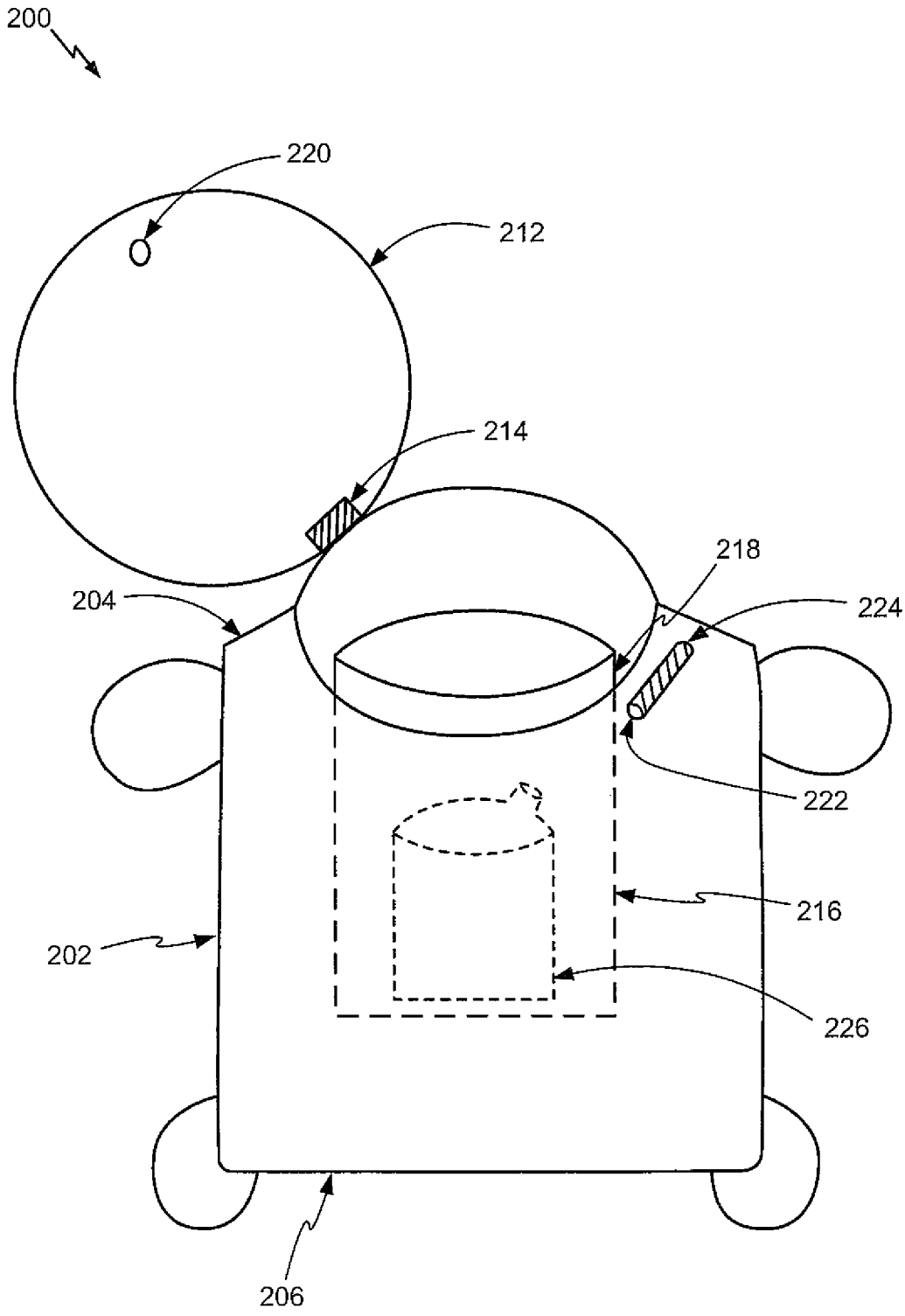
FIG. 6 is a side elevational view of a cup cover in accordance with one or more embodiments.

Referring now to FIG. 6, there is illustrated a side elevational view of a cup cover 200, in accordance with one embodiment. The general appearance of the cover 200 may comprise a configuration that may be appealing to a child, and is not limited to that illustrated in FIG. 6. In this embodiment, cover 200 comprises a body 202, an upper portion 204 and a lower portion 206. Body 202 may be formed from one or more materials, such as plush materials, and may be stuffed in at least one embodiment. Upper portion 204 and/or lower portion 206 may include an opening that may define a cavity 218, for example. A pocket 216 may be disposed in cavity 218, for example. Cavity 218 may additionally include cavity walls 210. Pocket 216 may be at least partially disposed in and/or coupled to body 202, for example. Pocket 216 and/or a portion of the cavity 218, such as cavity walls 210 may be adapted to receive a portion of a cup 226. Pocket 216 and/or cavity walls 210 may be formed from one or more material stated previously. Cup 226 may comprise one or more of the cups mentioned previously. For example, in one embodiment cup 226 may include a straw 224. Straw 224 may be configured to pass at least partially through a hole and/or slot formed through at least a portion of body 202 and/or configurable top 212. As one example, as illustrated in FIG. 6, a hole 222 is formed in body 202, and straw 224 may be configured to pass at least partially through hole 222. Additionally, a hole 220 may be formed in configurable top 212. Straw 224 may be configured to pass through slot 220 when configurable head 212 is tilted such as to at least partially cover cavity 218, for example. However, in alternative embodiments, one or more slots, perforations and/or other features may be formed in body 202 and/or head 212 to provide capabilities similar to holes 220 and/or 222.

Configurable top 212 may be attached at one or more locations to body 202, and may be attached at one or more locations 214, to allow top 212 to be positioned at different orientations with respect to body 202, for example. Top 212 may comprise a portion of the overall animal or creature caricature, such as the head, in at least one embodiment. Top 212 may be configurable to provide covering functions for a portion of cavity 216, and/or portions of cup 226 when the cup is inserted at least partially in cavity 216 and/or pocket 218, for example. Top 212 may include attachment portions, such as explained previously. Attachment portions may enable repositioning of the top 212 relative to the body 202, as described previously.

It is, of course, now appreciated, based at least in part on the foregoing disclosure, that although particular embodiments have just been described, claimed subject matter is not limited in scope to a particular embodiment or implementation. For example, a cover formed in accordance with one or more of the foregoing embodiments may be suited to perform one or more of the functions disclosed herein. Additionally, in the preceding description, various aspects of claimed subject matter have been described. For purposes of explanation, specific materials and/or configurations were set forth to provide a thorough understanding of claimed subject matter. However, it should be apparent to one skilled in the art having the benefit of this disclosure that claimed subject matter may be practiced without the specific details. In other instances, well-known features were omitted and/or simplified so as not to obscure claimed subject matter. While certain features have been illustrated and/or described herein, many modifications, substitutions, changes and/or equivalents will now occur to those skilled in the art. It is, therefore, to be understood that the appended claims are intended to cover all such modifications and/or changes as fall within the true spirit of claimed subject matter.

The invention claimed is:

1. A cup cover, comprising:

a body portion having an opening, wherein the opening defines at least a portion of a cavity;

a configurable head portion coupled to the body portion, wherein the configurable head portion is capable of being configured to selectively tilt to at least in part cover and/or uncover at least a portion of the cavity while the configurable head portion is attached at least at one point to the body portion, at least in part to allow access to a fluid in said cup, wherein at least a portion of the body portion and at least a portion of the configurable head portion form a caricature of an animal or other creature, and wherein the configurable head portion allows access to a fluid in the cup only in an at least in part uncovered position; and one or more attachment portions coupled to at least a portion of the cup cover, wherein the one or more attachment portions enable repositioning of the configurable head portion relative to the body portion; wherein at least a portion of the cup cover is formed from at least one of: plush material, terrycloth, velour, cotton, polyester, and/or combinations thereof.

2. The cup cover of claim 1, wherein the cavity is configured to receive at least a portion of a spill proof cup and/or to secure at least a portion of the cup in the body portion.

3. The cup cover of claim 1, and further comprising a pocket substantially disposed in the cavity, wherein the pocket is configured to receive at least a portion of a spill proof cup.

4. The cup cover of claim 1, wherein the attachment portions comprise one or more of: hook and loop fasteners, buttons, snaps, and/or hooks.

5. The cup cover of claim 3, wherein said pocket is formed from one or more materials having at least one of the following properties: elastic, non-elastic, absorbent, high friction, and/or waterproof.

6. The cup cover of claim 1, wherein the body includes at least one aperture portion, adapted to allow access to a portion of the pocket.

7. The cup cover of claim 1, wherein the body includes at least one draped portion, adapted to allow access to a portion of the pocket.

8. A system, comprising:

a body portion having an opening that defines a cavity;

a spill proof cup having a top, wherein the spill proof cup is at least partially disposed in the cavity;

a configurable head portion coupled to the body portion, wherein the configurable head portion is capable of being configured to selectively tilt to cover and/or uncover at least a portion of the top of the spill proof cup while the configurable head portion is attached at least at one point to the body portion, wherein the configurable head portion allows access to a fluid in the spill proof cup only in an at least in part uncovered position;

one or more attachment portions coupled to at least a portion of the body portion and/or the configurable head portion, wherein the one or more attachment portions enable repositioning of the configurable head portion relative to the body portion; wherein the body includes at least one of: an aperture portion, adapted to allow access to a portion of the pocket, and/or at least one draped portion, adapted to allow access to a portion of the pocket.

9. The system of claim 8, and further comprising:

a pocket substantially disposed in the cavity, wherein the pocket is configured to receive at least a portion of a spill proof cup.

10. The system of claim 8, wherein at least a portion of said body portion and at least a portion of said configurable head portion form a caricature of an animal or other creature.

11. An article, comprising:

means for covering a spill proof cup having a body and a head, wherein the means for covering comprises:

means for covering at least a portion of the body of the spill proof cup, wherein the means for covering forms the general appearance of a stuffed animal or creature; and means for enabling tilting of the head relative to the body to at least in part to allow access to a fluid in said spill proof cup only in an at least in part uncovered position; wherein said fluid is accessible while the head is attached at least at one point to at least a portion of the body; wherein at least a portion of the body and/or the head is formed from at least one of: plush material, terrycloth, velour, cotton, polyester, and/or combinations thereof.

12. The article of claim 11, wherein the means for covering comprises:

a body portion having an opening, wherein the opening defines a cavity; and a configurable head coupled to the body portion, wherein the configurable head is capable of being configured to selectively cover and uncover at least a portion of the cavity.

13. The article of claim 12, and further comprising a pocket substantially disposed in the cavity, wherein the pocket is configured to receive at least a portion of a spill proof cup.

14. The article of claim 11, wherein the body includes at least one of: an aperture portion, adapted to allow access to a portion of a pocket, and/or at least one draped portion, adapted to allow access to a portion of a pocket.

* * * * *